US005123332A

United States Patent [19]

Thayer et al.

[11] Patent Number: 5,123,332

[45] Date of Patent: Jun. 23, 1992

[54] CONDITION-RESPONSIVE DEVICE WITH DIAPHRAGM PROTECTION MEANS

[75] Inventors: James R. Thayer, Versailles; Henry J. Boulanger, Nicholasville; Bryan C. Jansen, Lexington, all of Ky.

[73] Assignee: Texas Instruments Incorporated, Dallas, Tex.

[21] Appl. No.: 730,326

[22] Filed: Jul. 15, 1991

[51] Int. Cl.[5] ..... F01B 19/00

[52] U.S. Cl. ..... 92/103 M; 92/129; 200/83 P

[58] Field of Search ..... 92/89, 91, 103 R, 103 M, 92/104, 129, 96, 101; 200/83 P; 251/75

[56] References Cited

U.S. PATENT DOCUMENTS

| | | | |
|---|---|---|---|
| 2,703,107 | 3/1955 | Baker | 92/101 |
| 3,588,395 | 6/1971 | Hersey | 92/101 |
| 3,719,320 | 3/1973 | Morris et al. | 251/75 |
| 4,573,398 | 3/1986 | Johnson et al. | 92/103 M |
| 4,667,069 | 5/1987 | Cholkeri | 200/83 P |
| 4,920,240 | 4/1990 | Poling | 200/83 P |

FOREIGN PATENT DOCUMENTS

| | | | |
|---|---|---|---|
| 8806799 | 9/1988 | PCT Int'l Appl. | 200/83 P |
| 297216 | 9/1928 | United Kingdom | 92/101 |

*Primary Examiner*—Thomas E. Denion

*Attorney, Agent, or Firm*—Russell E. Baumann; Richard L. Donaldson; Rene E. Grossman

[57] ABSTRACT

A control device has a nested stack of dished disc elements disposed in a cup beneath a diaphragm to move toward an inverted dished configuration with snap action to perform a control function or the like in response to occurrence of a predetermined pressure applied to the discs through the diaphragm. An annulus or bolster disposed between the rim of the cup and the diaphragm has an inner diameter nested in closely spaced relation to the domed, central portion of the dished element at the top of the stack normally cooperate with the stack of elements in supporting the diaphragm against pressure applied to the diaphragm. The annulus protects the diaphragm from being damaged by being pressed against peripheral portions of the disc elements when the discs move with snap action to their inverted dished configurations. The cup configuration is selected to include an increment in the cup side wall corresponding to each dished disc element in the stack thereby to permit convenient mounting of the diaphragm in precise position relative to the elements in an inexpensive, durable, welded and sealed structure while permitting accommodation of different numbers of disc elements in the cup as desired to provide devices with predetermined different actuating pressure characteristics.

7 Claims, 1 Drawing Sheet

CONDITION-RESPONSIVE DEVICE WITH DIAPHRAGM PROTECTION MEANS

BACKGROUND OF THE INVENTION

The field of the invention is that of condition-responsive devices and the invention relates more particularly to pressure responsive devices adapted to be exposed to relatively high fluid pressures.

Conventional condition-responsive devices such as pressure switches have a diaphragm arranged to be exposed to an applied fluid pressure at one side of the diaphragm and have at least one dished disc element arranged against an opposite side of the diaphragm to normally support the diaphragm against the applied pressure. The dished disc element is of a conventional type having a dished central portion which is movable from an original dished configuration to or toward an inverted dished configuration with snap action when the pressure applied to the element through the diaphragm reaches a predetermined disc actuating pressure level. The dished element is arranged to move a motion transfer pin or the like during snap acting movement of the element to perform a control function such as switching electrical contacts in an adjacent device chamber. Typically the diaphragm is sealed to a device base by welding to isolate the pressure medium from the switching chamber and typically the dished disc element is adapted to return to its original dished configuration with snap action when the applied pressure falls to a predetermined reset pressure level to reset the device. Where the device is to be exposed to very high actuating pressures, a stack of the dished disc elements is arranged in nested relation to provide the support for the diaphragm. Different members of the dished disc elements are used in the stack to adapt different devices to display different actuating and reset pressure characteristics. Where the diaphragm is to be exposed to high pressures, it is desirable to provide support substantially across the full expanse of the diaphragm.

In such known devices, it is found that, when the peripheral portions of the dished disc elements move toward the diaphragm during snap acting movement of the discs, the diaphragm can be damaged so that its service life is shortened. That is, high pressures applied to the diaphragm can force the diaphragm to conform to the configuration of the peripheral parts of the stack of inverted dished disc elements and can cause excessive diaphragm material deformation at that location, thereby altering the service life and performance of the diaphragm. It is also difficult to provide such devices having durable, sealed and welded constructions in an inexpensive manner while also permitting the devices to accommodate different numbers of dished disc elements in stacked, nested relation to each other within the devices to provide devices with desired different response characteristics.

BRIEF SUMMARY OF THE INVENTION

It is an object of the invention to provide a novel and improved condition-responsive device; to provide a pressure responsive device particularly adapted for use under high pressure conditions; to provide such a device which furnishes close support for a diaphragm during long periods of exposure to applied pressures before device actuation; to provide such a device which assures adequate support for the diaphragm after device actuation; and to provide such devices having inexpensive, durable, sealed and welded constructions conveniently adapted to accommodate different numbers of dished disc elements in a stacked, nested relation to each other to provide devices having precisely predetermined actuating and reset pressure response properties.

Briefly described, the novel and improved condition-responsive device of the invention comprises a cup having a bottom, a side-wall and a rim and having an opening in the bottom in which a motion transfer pin or the like is slidably movable to perform a control function such as switching electrical contacts or the like in an adjacent chamber. A port member is disposed over the open end of the cup to receive a pressure medium whose pressure is to be monitored, and a diaphragm is secured between the port member and the rim of the cup to isolate or separate the pressure medium from the adjacent switching chamber. At least one dished disc element is disposed within the cup with a domed central portion of the element arranged in supporting relation to the diaphragm. Each dished element is movable from an original dished configuration to or toward an inverted dished configuration with snap action when a selected pressure force is applied to the domed central portion of the element through the diaphragm, thereby to move the motion transfer pin to perform the desired control function. Where the device is to be actuated in response to a very high applied pressure, a stack of the dished disc elements is typically disposed in nested relation to each other within the cup, the elements being selected so that each element provides an increment of support for the diaphragm until a predetermined device actuating pressure is reached. The elements in the stack then move to or toward their inverted dished configuration substantially simultaneously.

In the device of the invention, a bolster or annulus is secured between the rim of the cup and the diaphragm to intercept movement of the peripheral portions of the dished elements as they move to or toward their inverted dished configurations, thereby to protect the diaphragm. The annulus has an inner diameter selected to nest in closely spaced relation to the domed central portion of the disc element in the cup, or to the domed central portion of the element on top of a stack of elements in the cup, so that the annulus and dished elements cooperate to provide close support for substantially the full expanse of the diaphragm against an applied pressure. The cup structure is also selected so it is easily arranged to have an increment of the cup side wall provided corresponding to each dished disc element accommodated in the cup, and the port member, diaphragm and annulus are easily welded in a sealed relation to the rim of the cup at the same time, thereby to provide devices with durable, sealed constructions in an inexpensive manner while permitting the device to be easily adapted to display different actuating and reset pressure characteristics in precisely predetermined manner.

DESCRIPTION OF THE DRAWING

Other objects, advantages and details of the novel and improved condition-responsive device of the invention appear in the following detailed description of preferred embodiments of the invention, the detailed description referring to the drawing in which.

DESCRIPTION OF THE PREFERRED EMBODIMENTS

Figure 1:
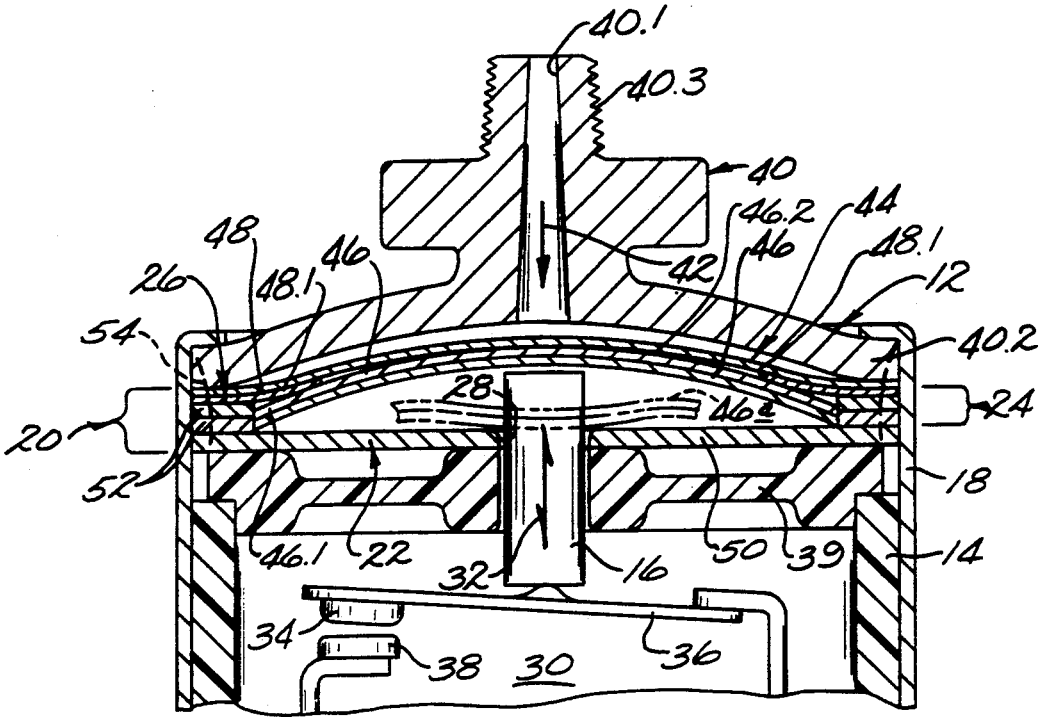
FIG. 1 is a section view along a longitudinal axis of a preferred embodiment of the condition-responsive device of the invention.

Referring to the drawing, 10 in FIG. 1 indicates a preferred embodiment of the novel and improved condition-responsive device of the invention. In this embodiment, the invention is implemented in the form of an electrical switch and includes a pressure sensing unit 12, a switch base 14, and a motion transfer pin 16 or the like which are held in assembled relation as shown in FIG. 1 by a metal sleeve 18 swaged to the base and to the pressure sensing unit.

The pressure sensing unit 12 comprises an inexpensive, durable, sealed and welded structure which includes a cup means 20 having a bottom 22, a side wall means 24 and a rim 26 and having an opening 28 in the cup bottom. The motion transfer pin 16 is slidably movable in the opening 28 to perform a control function or the like in an adjacent chamber 30 of the device. For example, the motion transfer pin is adapted to be moved in one direction as indicated by the arrow 32 to move the contact 34 against the spring bias of the contact arm 36 in the switch base 14 to engage the contact 34 with the complementary contact 38 also mounted in the switch base. The motion transfer pin is also adapted to move in an opposite direction in response to the spring bias of the arm to allow separation of the contacts. Preferably the device includes a pin guide 39 held between the pressure unit and switch base by the sleeve.

In accordance with the invention, the pressure sensing unit also comprises a metal port member 40 which is disposed over the open end of the cup means 20, the port member having a central opening 40.1 for introducing a pressure medium to the device 10 as indicated by the arrows 42, having a periphery 40.2 disposed to be coextensive with the cup rim 26, and preferably a nipple 40.3 or the like to permit convenient attachment of the port member to a pressure line. A metal diaphragm 44 of stainless steel or the like is secured between the peripheral part of the port member and the rim 26 of the cup means. The thickness of the diaphragm is selected to permit the diaphragm to move toward and away from the switch base as the applied pressure force 42 is increased and decreased respectively but to permit the diaphragm to resist bursting in response to the levels of pressure likely to be encountered.

At least one dished metal disc element 46 is disposed within the cup means 20 with a periphery 46.1 of the element normally resting on the cup bottom and with a domed, central portion 46.2 of the element normally disposed in supporting relation to the diaphragm against the applied pressure force 42. Preferably as shown in FIG. 1, a stack of the dished metal elements is disposed in nested relation to each other within the cup with a peripheral part of one element at the bottom of the stack resting on the cup bottom and with a domed central part of another element at the top of the stack disposed against the diaphragm. A metal annulus 48 is secured between the diaphragm and the cup rim, the annulus having an inner diameter 48.1 which is disposed in closely spaced, nested relation to the domed central portion of the dished element at the top of the stack so that the annulus cooperates with the stack of dished elements to normally support the diaphragm against an applied pressure force.

In the preferred embodiment of the invention as shown in FIG. 1, the cup means 20 of the pressure sensing unit 12 comprises a flat or slightly conical metal washer 50 forming the cup bottom 22. One or more metal rings 52 are also arranged in stacked relation to each other around the periphery of the washer to form the side wall 24 of the cup, one ring being included in the stack for each selected number of the dished disc elements 46 disposed within the cup so that the cup side wall includes an increment for or corresponding to each of the stacked dished elements. For example, where the stack of elements might typically contain two, four or six elements, the side wall may include, for example, one two or three rings respectively, thereby providing support for the annulus 48 in the same spacial relation to the top element in the stack of elements in each case. Preferably one ring at the bottom of the stack is relatively thicker than the other rings in the stack as shown. In that arrangement, the port member, diaphragm, annulus, rings, and washer are easily and reliably secured together in a single welding operation as indicated by the weld 54 in FIG. 1. However, because the side wall height properly corresponds to the height of the stack elements 46, the diaphragm 44 is disposed at the proper height to be provided close support by the annulus and the disc elements.

In the device 10 as thus described, each dished element 46 is of a conventional type which moves with snap action from an original dished configuration as shown in solid lines in FIG. 1 to or toward an inverted dished configuration as indicated by broken lines **46*a* in FIG. 1 when a selected disc actuating pressure or force is applied to the convex side of the element through the diaphragm as viewed in FIG. 1. Typically, where the cup 20 is proportioned as shown in FIG. 1, the cup bottom 22 intercepts the elements 46 in moving toward their invented dished configuration wo the elements are not fully inverted but tend to have a wavy configuration as indicated by the broken lines 46*a*. The element returns to its original configuration with snap action when that applied force is reduced to the reset force of the disc element. The actuating and reset forces of the disc element are characteristic of the element and accordingly when the stack of elements are disposed as shown in FIG. 1 each element contributes an increment of support to the diaphragm 44 and the number of dished elements in the stack determines the actuating and reset pressures of the device 10. That is, when the applied pressure 42 is less than the cumulative actuating forces of the stacked discs, the annulus and the stack of dished elements cooperate in providing support for substantially the full expanse of the diaphragm over a long service life so that, even though the applied pressure forces are quite high, the diaphragm is protected against slow deformation or the like such as might cause drift in the device response characteristics. However when the applied pressure reaches the actuating pressure of the device, all of the dished disc elements move to or toward their inverted dished configuration substantially simultaneously to move the motion transfer pin to perform its desired control function as above described. In that arrangement, the annulus protects the diaphragm by preventing pressing of the diaphragm against the peripheral parts of the snap acted dished elements so that the applied high pressures do not deform the diaphragm at the location of those elements peripheries. The structure of the pressure sensing unit is also easily adapted to accommodate any desired number of disc elements 46 to provide the device with a desired actuating pressure characteristic while still permitting the sensing unit to be easily assembled with a single weld and while assuring that the diaphragm is provided the same support from device to device by the annulus and the dished elements. The use of a single weld avoids damage to the resilience and service life of the diaphragm such as might occur if separate welds were required for attaching the port member, diaphragm, and annulus to the cup 20**.

Figure 2:
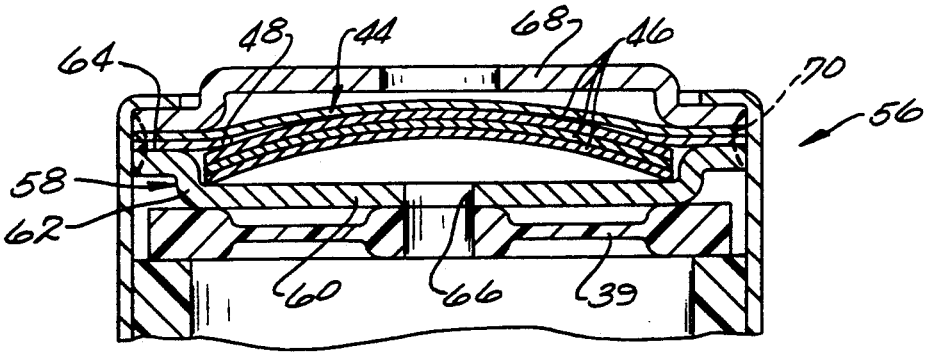
FIG. 2 is a section view similar to FIG. 1 illustrating an alternative preferred embodiment of the invention.

In an alternate preferred embodiment of the invention as shown in FIG. 2, in which corresponding components are identified with corresponding reference numerals, the device 56 comprises a cup mean 58 having a bottom 60, a side wall 62 and a rim 64 and having an opening 66 in the bottom of the cup. Preferably the cup 58 is formed of deep-drawn metal such as steel but the cup is also formed by machining, by powder metallurgy or in other well known manner within the scope of the invention. A stack of dished elements 46 is disposed within the cup and the side wall of the cup is drawn to include an increment of the side wall for each element 46 in the stack. A port member 68 is disposed over the open end of the cup. The port member typically comprises a drawn or otherwise formed metal part as shown. The diaphragm 44 and annulus 48 are secured between the port member and the rim 64 of the cup and the port member, diaphragm, annulus, and cup are secured together in sealed relation in a single seam welding operation as indicated by the weld 70. Again the pressure sensing unit 58 comprises a durable, sealed and welded construction which is inexpensively manufactured to accommodate any desired number of dished elements 46 to provide the unit with desired actuating and/or reset pressure characteristics. The cup is easily modified to accommodate the desired number of discs while still permitting close positioning of the annulus and elements against the diaphragm and while still permitting inexpensive and reliable assembly and sealing of the unit with a single weld.

It should be understood that although particular embodiments of the invention have been described by way of illustrating the invention, the invention includes modifications and equivalents of the described embodiments. For example the dished elements used in the device can be formed of bimetal materials or the like to be temperature as well as pressure responsive within the scope of the invention. The condition-responsive device of the invention can also be adapted as a valve control device or the like as well be understood. The invention includes all modifications and equivalents of the disclosed embodiment falling within the scope of the appended claims.

We claim:

1. A condition-responsive control device comprising a cup having a bottom, side-wall means and a rim and having an opening in the bottom, a pin movable in the bottom to perform a control function in a chamber, a port member disposed over an open end of the cup to furnish a medium whose condition is to be monitored, a diaphragm disposed between the port member and the cup rim to separate the medium from the chamber, and dished disc means disposed in the cup having a dished central portion movable with snap action from an original dished configuration toward an inverted dished configuration on occurrence of a selected condition in the medium for moving the pin to perform the control function and having a peripheral portion movable toward the diaphragm from a position resting on the cup bottom during the snap-acting movement, the device having an annulus secured between the cup rim and the diaphragm with an inner diameter portion in direct contact with the dished central portion of the dished disc means to intercept movement of the peripheral portion of the dished disc means toward the diaphragm to protect the diaphragm.

2. A condition-responsive control device comprising a cup having a bottom, side-wall means and a rim and having an opening in the bottom, a pin movable in the bottom to perform a control function in a chamber, a port member disposed over an open end of the cup to furnish a medium whose condition is to be monitored, a diaphragm disposed between the port member and the cup rim to separate the medium from the chamber, and dished disc means disposed in the cup having a dished central portion movable with snap action from an original dished configuration toward an inverted dished configuration on occurrence of a selected condition in the medium for moving the pin to perform the control function and having a peripheral portion movable toward the diaphragm from a position resting on the cup bottom during the snap-acting movement, the device having an annulus secured between the cup rim and the diaphragm to intercept movement of the peripheral portion of the dished disc means toward the diaphragm to protect the diaphragm, wherein an inner diameter of the annulus is nested with the dished central portion of the dished disc means so that the diaphragm is supported against the annulus and dished central portion of the dished disc means until occurrence of said selected condition.

3. A condition-responsive control device according to claim 2 wherein the dished disc means comprises a stack of dished disc elements disposed in nested relation to each other and the side-wall means of the cup includes an increment thereof for each disc element to dispose the inner diameter of the annulus in closely spaced nested relation to an outermost element of the stack.

4. A pressure-responsive control device comprising a formed metal cup having a bottom, a side wall and an integral rim flange and having an opening in the bottom, a pin movable in the opening to perform a control function in a chamber, a metal port member disposed over an open end of the cup to furnish a medium whose pressure is to be monitored, a metal diaphragm secured between the port member and the rim flange of the cup to separate the pressure medium from the chamber, and a plurality of dished disc elements disposed in the cup in a stack in nested relation to each other with a peripheral portion of one of said elements at one end of the stack resting on the cup bottom and with a domed central portion of another one of said elements at an opposite end of the stack disposed against the diaphragm, the dished disc elements in the stack each having a dished central portion movable with snap action from an original dished configuration toward an inverted dished configuration on occurrence of a selected pressure condition in the medium for cooperating to move the pin to perform the control function and having a peripheral portion movable toward the diaphragm during the snap-acting movement, the device having a metal annulus disposed between the cup rim flange and the diaphragm to intercept movement of the peripheral portions of the disc elements toward the diaphragm to protect the diaphragm, the side wall of the cup including an increment thereof for each disc element in the stack to dispose an inner diameter of the annulus in closely spaced nested relation with the dished central portion of a disc element at an opposite end of the stack so that the annulus and stack of disc elements cooperate in supporting the diaphragm against the pressure until occurrence of the selected condition.

5. A pressure responsive control device according to claim 4 wherein a common weld secures the port member, the diaphragm, the annulus and the rim flange of the cup together and seals the chamber from the pressure medium.

6. A pressure responsive control device comprising a metal washer and a plurality of metal rings secured together to form a cup having a bottom, a side wall and a rim and having an opening in the bottom, a pin movable in the opening to perform a control function in a chamber, a metal port member disposed over an open end of the cup to furnish a medium whose pressure is to be monitored, a metal diaphragm secured between the port member and the rim of the cup to separate the pressure medium from the chamber, and a plurality of dished disc elements disposed in the cup in a stack in nested relation to each other with a peripheral portion of one of said elements at one end of the stack resting on the cup bottom, the dished disc elements in the stack each having a dished central portion movable with snap action from an original dished configuration toward an inverted dished configuration on occurrence of a selected pressure condition in the medium for cooperating to move the pin to perform the control function and having a peripheral portion movable toward the diaphragm during the snap-acting movement, the device having a metal annulus disposed between the cup rim and the diaphragm to intercept movement of the peripheral portions of the disc elements towards the diaphragm to protect the diaphragm, the metal rings included within the cup forming the side wall of the cup corresponding to each disc element in the stack to dispose an inner diameter of the annulus in closely spaced nested relation with the dished central portion of another one of said disc elements at an opposite end of the stack so that the annulus and stack of dished disc elements cooperate in supporting the diaphragm against the pressure in the medium until occurrence of the selected condition.

7. A pressure-responsive control device according to claim 6 wherein a common weld secures the washer, the metal rings, the diaphragm, the port member, and the annulus together and seals the chamber from the pressure medium.

* * * * *